US005781987A

United States Patent [19]

Castrén

[11] Patent Number: 5,781,987

[45] Date of Patent: *Jul. 21, 1998

[54] APPARATUS FOR MANUFACTURING A NEEDLE-RIB HEAT-EXCHANGER CONSTRUCTION

[75] Inventor: Risto Castrén, Lahti, Finland

[73] Assignee: Retermia Oy, Heinola, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 563,677

[22] Filed: Nov. 28, 1995

[51] Int. Cl.[6] ..... B23P 15/26

[52] U.S. Cl. ..... 29/727; 29/890.048

[58] Field of Search ..... 29/727, 782, 781, 29/820, 890.048, 33 G, 33 T, 33 D; 72/66

[56] References Cited

U.S. PATENT DOCUMENTS

| | | | |
|---|---|---|---|
| 2,372,795 | 4/1945 | Rodeck | 29/727 |
| 2,847,055 | 8/1958 | Matheny et al. | 29/727 |
| 3,022,049 | 2/1962 | Abbott | 29/890.048 |
| 3,417,451 | 12/1968 | Gunter et al. | 29/727 |
| 3,550,235 | 12/1970 | Jarvis et al. | 29/157.3 |
| 3,789,786 | 2/1974 | Wiedenmann et al. | 29/727 |
| 4,542,568 | 9/1985 | Venables, III et al. | 29/727 |
| 5,022,149 | 6/1991 | Abbott | 29/727 |

FOREIGN PATENT DOCUMENTS 1349909 4/1974 United Kingdom .

*Primary Examiner*—Irene Cuda

*Attorney, Agent, or Firm*—Steinberg & Raskin, P.C.

[57] ABSTRACT

An apparatus for manufacturing a needle-rib heat-exchanger construction including a band which is wound around a tube. Initially, cuts are formed on both sides of an elongate band and thereafter the band is passed through a series of engaging former wheels. A bottom part is formed into the band and top portions of the band are folded onto the bottom part. Needle-shaped ribs are formed to project from the top portions and are placed at an angle in relation to one another. The band with needle-shaped ribs is then mounted on the tube.

15 Claims, 6 Drawing Sheets

APPARATUS FOR MANUFACTURING A NEEDLE-RIB HEAT-EXCHANGER CONSTRUCTION

FIELD OF THE INVENTION

The present invention relates to a method and apparatus for manufacturing a ribbed heat-exchanger tube and more particularly to a method and apparatus for manufacturing a needle rib which is mounted to a heat exchanger tube.

BACKGROUND OF THE INVENTION

In the prior art, various lamellar heat exchangers are known whose heat transfer properties are not optimal in view of the efficiency of heat transfer. Various heat transfer devices consisting of needle-shaped ribs are also known, in which the heat transfer capacity is considerably higher than in ordinary lamellar heat exchangers.

OBJECTS AND SUMMARY OF THE INVENTION

It is an object of the present invention to provide a new and improved apparatus for manufacturing a ribbed heat-exchanger tube in which the heat transfer properties are optimal in view of the efficiency of heat transfer.

It is another object of the present invention to provide a new and improved apparatus for manufacturing a needle-rib heat exchanger having an efficiency which is maximal in view of the transfer of heat.

Accordingly, the needle-rib heat exchanger manufactured by means of the apparatus in accordance with the invention is made of a band or strip which is wound around a tube that transfers the heat-exchanger medium, i.e., the medium passes through an interior of the tube. In the apparatus, the band is first punched and then is guided via a number of former wheels or roller wheels to form needle-shaped heat transfer ribs. In the punching operation, cuts are made in the sides of the band at mutual distances determined by the width of the needle ribs. After this, the band is passed via the roller wheels which shape the punched band. On completion of the shaping, the heat transfer band in accordance with the invention comprises a sectional form in which there is a bottom portion and top portions that have been folded onto the bottom portion. From the top portions, rows of needle ribs project so that, in relation to the central axis (Y-axis) of the cross-section of the band, an acute angle is formed between the opposite ribs, the acute angle being favorably about 20°.

More particularly, in the apparatus, after the rib cuts have been made, the band is shaped in five stages. In the first shaping stage A, a rounding is formed into the cross-section of the band into its middle area, and after that, in stage B, two folds are rolled to both sides of the roundings. After stage B, the sides of the band are raised by means of the forming wheels in stages C and D. In the last stage E, the ultimate shape of the band is obtained, in which the top sides of the band have been pressed to the vicinity of one another from the outer folds that were formed in the stage B. Then, the needle ribs have been raised to the ultimate position. In the last stage E, the band is shaped by means of roller wheels on which the inner sides of the roller wheels, which are placed facing one another, are at an angle in relation to one another. The angle is in the range of from about 55° to about 65°. The tip angle B of the tips of the last roller wheels is acute, being in the range of from about 50° to about 60°. The tip of the roller wheel is placed along the fold formed in the band, in which case the opposite rib parts are placed in their precise ultimate positions, in which the angle between the rib portions is favorably about 20°. After this, the band is wound directly, upon application of an adhesive by means of an applicator wheel, around the tube intended for the transfer of the heat transfer medium or fluid. The tube is rotated and moved in its longitudinal direction during winding of the band thereon.

The apparatus in accordance with the invention comprises several pairs of roller wheels which are operated by means of a closed belt loop that is in motively coupled to an output drive shaft of a drive motor and in engagement with a drive pulley fitted on the shaft.

The method in accordance with the invention for the manufacture of a needle-rib heat exchanger is mainly characterized in that, in the method, cuts are formed to both sides of an elongate band; and the band is passed via sets, e.g., pairs, of nip-defining former wheels in which connection a bottom part is formed into the band, and top portions are folded onto the bottom part, out of which top portions needle-shaped ribs project, being placed at an angle in relation to one another.

The apparatus in accordance with the invention for the manufacture of a needle-rib heat exchanger is mainly characterized in that it comprises several sets, e.g., pairs, of nip-defining former wheels which are driven by a motor and by whose means the band is shaped before it is wound onto the tube;

a device for making cuts in both lateral sides of the band before the band is shaped by the former wheels; and a device by whose means the tube is rotated and fed forward, in which connection the ready-shaped band is wound onto the tube.

More particularly, the apparatus for manufacturing a needle-rib heat-exchanger construction in accordance with the invention comprises an elongate tube and a band wound onto the tube. The band has a central portion and a lateral portion on each side of the central portion. The apparatus comprises cutting means for cutting the lateral portions of the band, a set of former wheels for shaping the cut band, first rotation means for rotating the former wheels, and second rotation means for rotating the tube and moving the tube in the longitudinal direction whereby the band is guided through the rotating former wheels and wound onto the tube. The band is shaped by the former wheels to include a bottom part, opposed top portions and needle-shaped ribs projecting from a respective one of the top portions and situated at an angle in relation to one another.

The invention will be described in the following with reference to some preferred embodiments of the invention illustrated in the figures in the accompanying drawings. However, the invention is not confined to these embodiments alone.

BRIEF DESCRIPTION OF THE DRAWINGS

The following drawings are illustrative of embodiments of the invention and are not meant to limit the scope of the invention as encompassed by the claims.

FIG. 2D shows a perspective view of the punching tool by whose means the cuts are formed as the punching tool strikes a back-up blade and as the band is passed between the striking tool and the back-up blade.

FIG. 2E is a perspective view of part of the band as it appears after the punching operation.

DETAILED DESCRIPTION OF THE PREFERRED EMBODIMENT

Figure 1B:
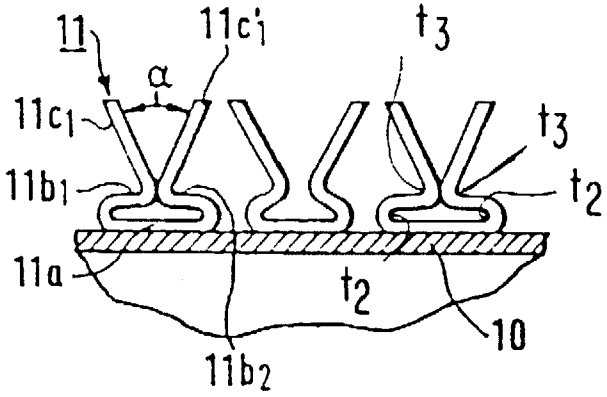
FIG. 1B is a partial sectional view taken along line I—I in FIG. 1A.
Figure 1A:
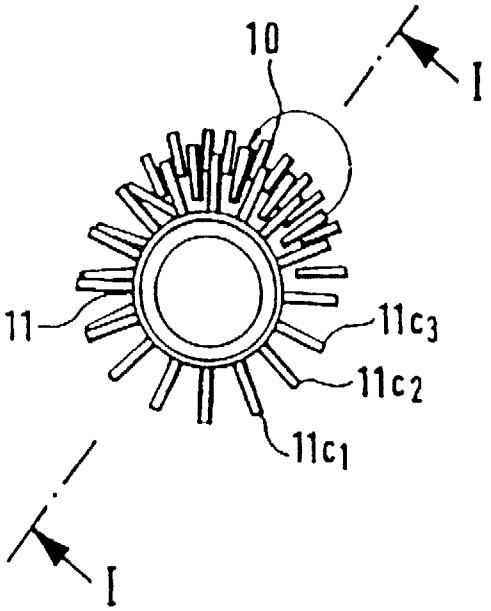
FIG. 1A is a perspective view of a needle-rib heat exchanger tube.

Referring to the accompanying drawings wherein the same reference numerals refer to the same or similar elements, FIG. 1A is a perspective view of a heat-exchanger tube construction manufactured by means of the apparatus in accordance with the invention and by the method in accordance with the invention. The heat-exchanger rib-tube construction comprises a central tube 10 and a band 11 which has been wound and glued onto the tube and which comprises needle ribs $11c'_1$, $11c'_2$, $11c'_3$ . . . A heat exchanger medium is operatively transferred through the interior of the tube 10.

As shown in more detail in FIG. 1B, the tube 10 which transfers the heat exchanger medium comprises the band 11 wound around the tube. Band 11 has a cross-sectional form in which there is a bottom or base portion 11*a*. On the bottom portion 11*a*, top portions $11b_1$ and $11b_2$ extend and needle-shaped ribs $11c_1$ and $11c'_1$ project from the top portions $11b_1$ and $11b_2$, respectively. The opposite ribs are placed at an acute angle $\alpha$ in relation to one another, the angle $\alpha$ being favorably about 20°. The cross-sectional form thus defines folds $t_2$ and $t_3$. The top portions $11b_1$ and $11b_2$ are thus inner segments of the lateral portions of the band 11 while the needle-shaped ribs $11c_1$ and $11c'_1$ are outer segments of the lateral portions of the band 11.

Figure 2A:
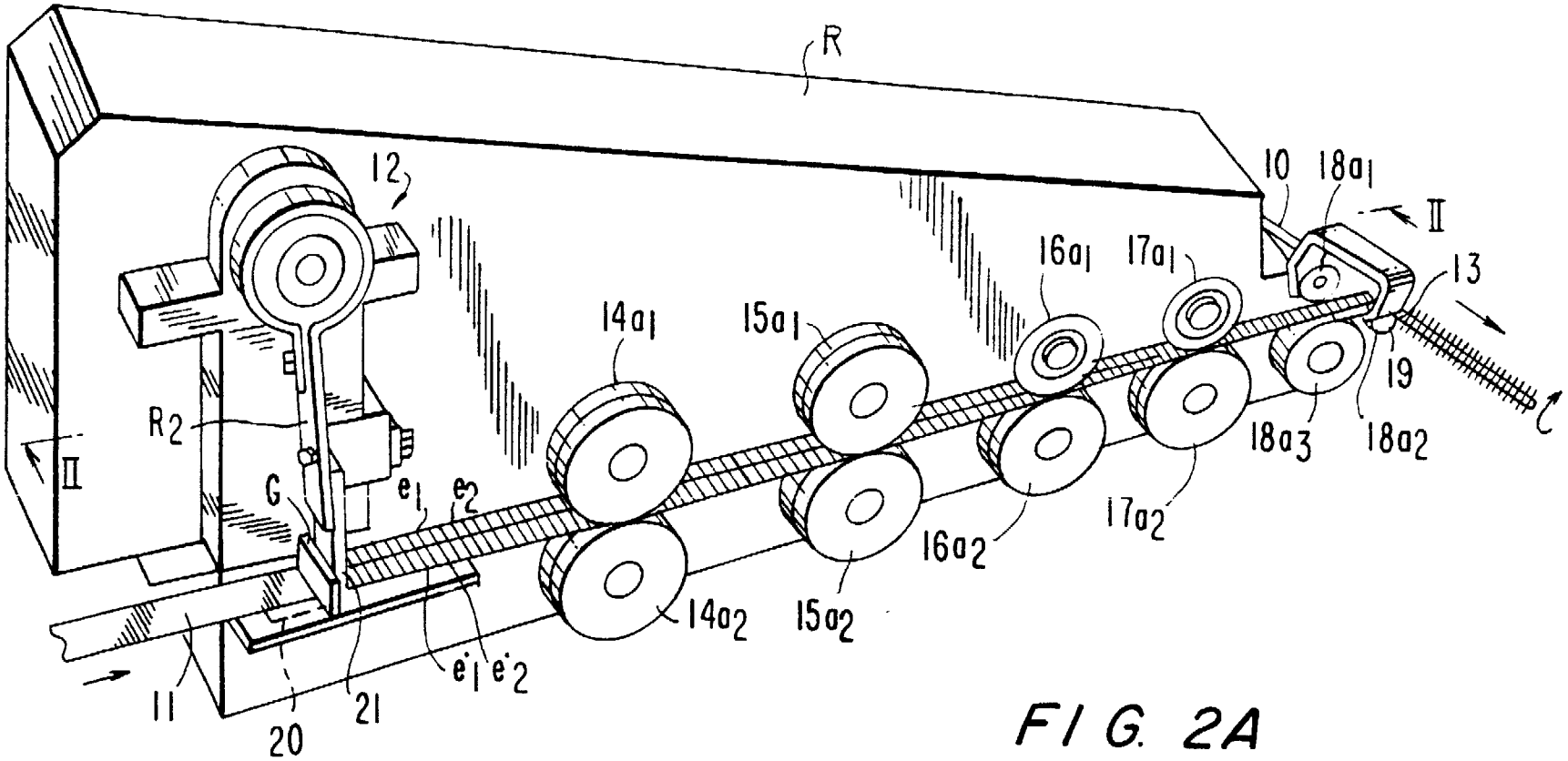
FIG. 2A is a perspective view of an apparatus in accordance with the invention.

FIG. 2A is a side view of an apparatus in accordance with the invention for the manufacture of a heat-exchanger needle-rib construction. In the apparatus, sets of nip-defining former wheels 14–18 are mounted on a frame R, and at least one wheel in each set of wheels is driven by a belt (not shown). The band 11 is wound onto the tube 10 after it has passed through the last set of former wheels $18a_1$,$18a_2$,$18a_3$ or roller wheels and after a glue applicator wheel 19 in an associated gluing device 13.

Figure 2B:
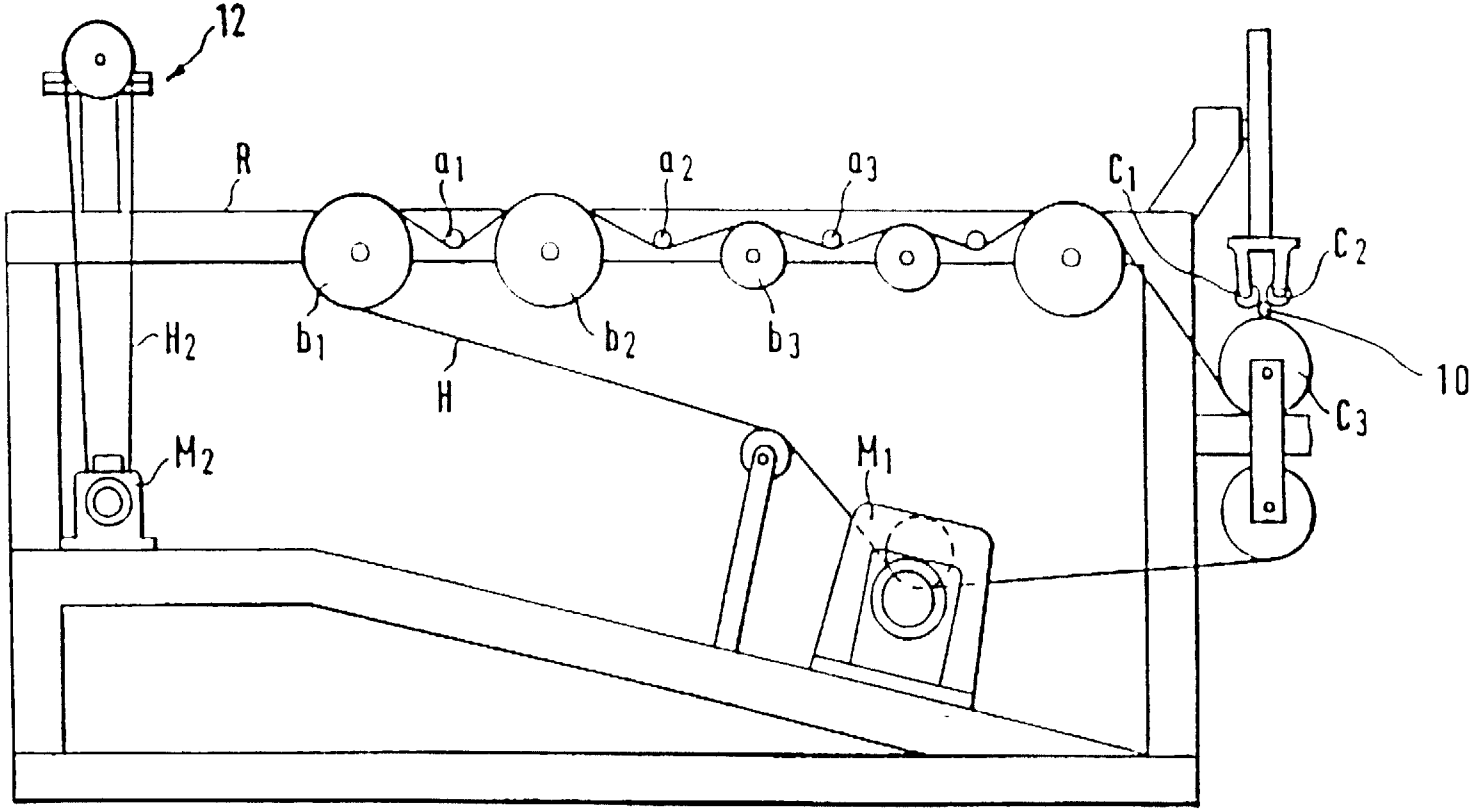
FIG. 2B is a sectional view taken along line II—II in FIG. 2A.

FIG. 2B is a sectional view of the apparatus taken along line II—II in FIG. 2A. A drive belt H is passed from the output shaft of a motor $M_1$ over guide pulleys $a_1$,$a_2$ . . . to drive pulleys $b_1$,$b_2$ . . . operatively coupled to the driven roller wheel of each set of roller wheels 14–18. The same belt H is passed onto a driven rotation disc or wheel $C_3$ on which the tube 10 rests. Two upper discs or wheels $C_1$,$C_2$ are placed at an angle in relation to one another. The central shafts of the discs $C_1$ and $C_2$ are placed obliquely in relation to one another so that a forward feed movement of the tube 10 is produced upon rotation of tube 10. The tube 10 is rotated by means of the driven wheel $C_3$.

A punching device 12 is operated by means of a separate motor $M_2$ by the intermediate of a belt $H_2$. The belt $H_2$ is in engagement with a shaft 23 which is connected with an eccentric shaft 23' which displaces the blade 21 relative to the band 11 (FIG. 2C as represented by arrow $L_3$).

In the first stage of manufacture, the punching device 12 punches the band 11 so as to form cuts $e_1$,$e_1'$,$e_2$,$e_2'$ . . . on both sides of the band 11 as shown in FIG. 2E. After this, the band 11 is passed sequentially via the former wheels 14–18 to be shaped thereby and then onto the applicator wheel 19 of the gluing device 13, and finally, having been brought to its finished form, the band is wound onto the tube 10 as the tube 10 rotates and advances.

Figure 2C:
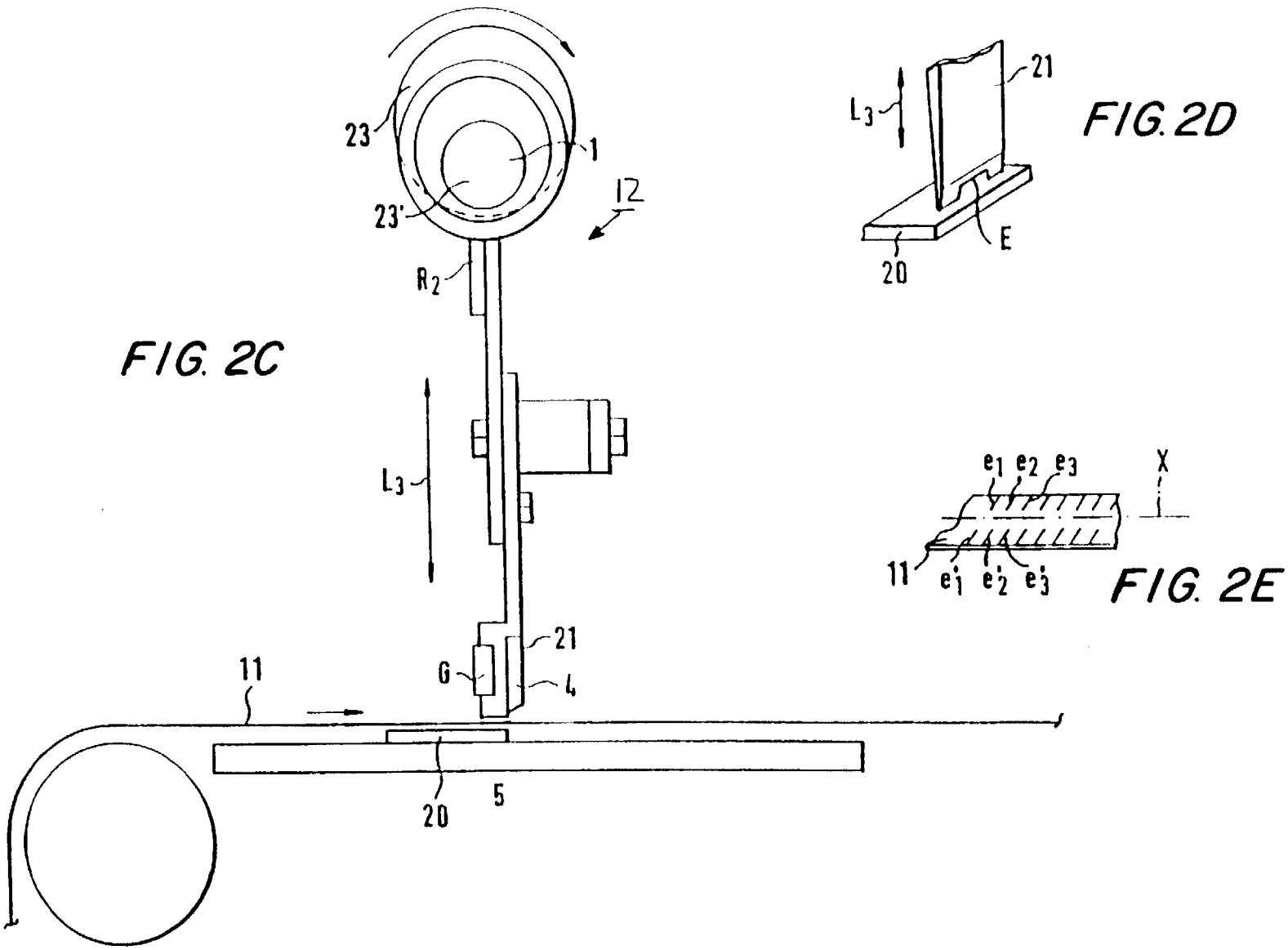
FIG. 2C is a side view of a punching device by whose means cuts are made into the sides of the band in order to form the ribs.

FIG. 2C is a side view of the punching device 12 that makes the lateral cuts in the band 11. The punching device includes cooperating punching blades 20,21. The band 11 is passed between punching blades 20,21 of the punching device 12 that make the lateral cuts $e_1$,$e_1'$;$e_2$,$e_2'$, . . . in the band 11. The punching blades comprise a lower mobile blade 20 and an upper stationary blade 21 as shown in FIG. 2D.

During operation, the shaft 23 is rotated by motor $M_2$ so that the eccentric cam or shaft 23' connected with the shaft 23 displaces the frame $R_2$ in the direction indicated by the arrow $L_3$ (FIG. 2C). The upper blade 21 performs the punching movement against the lower blade 20. The upper blade 21 is mounted by means of a glide bearing G so as to obtain precise guiding of the upper blade 21 in relation to the lower blade 20 (FIG. 2A). In the middle of the mobile upper blade 21, there is a space E positioned so that the blade 21 cuts just at both sides, i.e., forms cuts $e_1$,$e_1'$,$e_2$,$e_2'$,$e_3$,$e_3'$ . . . at the two sides of the band 11, and allows the middle area of the band 11 to remain uncut to provide for continuity of the band 11.

FIG. 2D is a perspective view of the relative positions of the mobile blade 21 and the stationary blade 20. As shown in FIG. 2D, in its middle area, the mobile blade 21 comprises the recessed or free space E whereby the blade 21 cuts at both of its sides only, thus making cuts into the band 11 at both sides of the band.

FIG. 2E shows a finished cut band 11 which comprises lateral cuts $e_1$,$e'_1$,$e_2$,$e'_2$,e3,$e'_3$ . . . at both sides of the longitudinal axis X of the band. The middle area of the band 11 is free from cuts (in view of the particular shape of the blade 21). Ribs $11c_1$,$11c_1'$,$11c_2$,$11c_2'$ . . . are thus able to be formed between the cuts.

In the forming stages illustrated in FIGS. 3A–3E, for the sake clarity, the band 11 is shown with diagonal shading and, for the sake of clarity of the illustration, the related nip-defining roller wheels are shown spaced apart by a small distance. FIGS. 3A–3E illustrate the different forming stages of the ribbed band 11 in accordance with the invention.

Figure 3A:
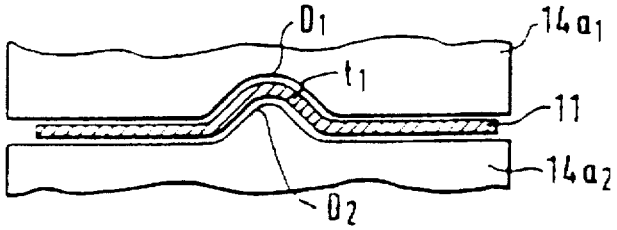
FIGS. 3A, 3B, 3C, 3D and 3E are cross-sectional views illustrating the shaping of the ribbed band step by step by means of pairs of roller wheels into its ultimate form, in which the band structure comprises a cross-sectional form in which there is a base portion, a top portion placed above the base portion, and ribs, so-called needle ribs, projecting from the top portions in opposite directions.

In the stage shown in FIG. 3A, the band is stretched in the middle area by former wheels 14, of which one wheel $14a_1$ comprises a groove and the other wheel $14a_2$ comprises a central projection of corresponding shape protruding from the wheel face. The groove on the wheel $14a_1$ is denoted by $D_1$, and the projection on the wheel $14a_2$ is denoted by $D_2$ and they are complementary to one another. By means of the wheels 14, the band 11 is stretched in the middle area of the band 11, and a rounding $t_1$ is formed therein.

Figure 3B:
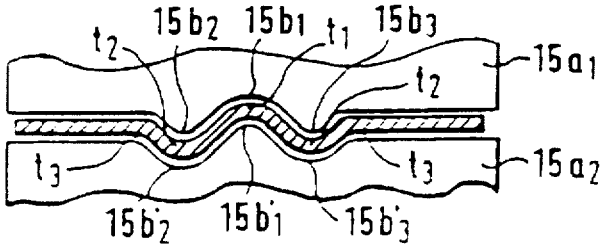

By means of the former wheels $15a_1$ and $15a_2$ shown in FIG. 3B, bends or folds $t_2$ and $t_3$ are formed into the band 11 at both sides of its central axis X and at both sides of the stretched middle area of the band 11 obtained by passage of the band 11 through wheels 14. The wheel $15a_1$ comprises a central arcuate groove $15b_1$ and arcuate projections $15b_2$ and $15b_3$ projecting from the wheel face at both sides of the central axis of the wheel. In a corresponding manner, the wheel $15a_2$ comprises grooves $15b_2'$, $15b_3'$ jointly operative with the projections $15b_2$ and $15b_3$ as well as a central projection $15b_1'$ which projects from the wheel face and which is jointly operative with the corresponding arcuate groove $15b_1$ on the wheel $15a_1$. Thus, by means of this pair of wheels 15, folds $t_2$ are formed into the band at the top side of the band, and folds $t_3$ are formed at the bottom side of the band at both sides of the central axis X of the band 11. The formation of folds is a preliminary step in the formation of the top portions $11b_1$,$11b_2$ above the base part 11*a* of the band 11 as will be described below.

Figure 3C:
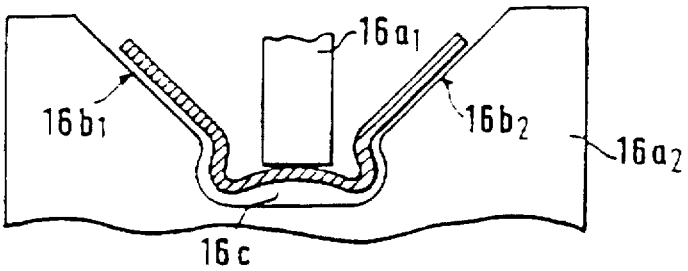

FIG. 3C illustrates the next forming stage, in which the forming is carried out by the pair of wheels $16a_1$, $16a_2$. The upper wheel $16a_1$ is a central cylindrical support or press wheel. The lower wheel $16a_2$ comprises, at both sides, conical side faces $16b_1$ and $16b_2$ placed at an angle of about 45° in relation to the vertical plane. Further, the lower former wheel $16a_1$ comprises a central groove 16*c*, whose vertical walls are connected with the lateral conical side faces $16b_1$,$16b_2$. By means of the passage of the band 11 through the space between and into engagement with wheels $16a_1$,$16a_2$, the rib portions $11a_1$,$11a_2$, . . . are raised from the substantially horizontal position as shown in FIG. 3B.

Figure 3D:
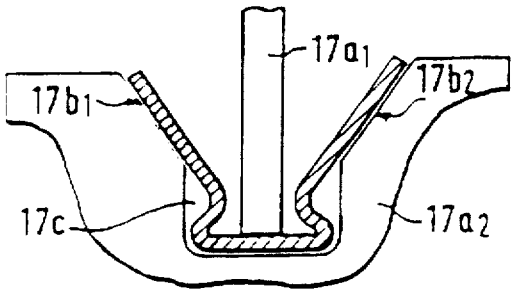

FIG. 3D shows a pair of wheels 17 which constitute the fourth forming stage. The upper wheel $17a_1$ is a cylindrical support or press wheel having a width of about 1 mm, which in the illustrated embodiment is smaller than the width of wheel $16a_1$. The lower wheel $17a_2$ has a shape similar to that of the lower wheel $16a_2$ in FIG. 3C, i.e., a groove 17*c* and connected conical faces $17b_1$,$17b_2$. The relative angle between the conical faces is smaller than the angle in the preceding forming stage, the angle being considered in relation to the vertical plane. Thus, by means of the pair of wheels $17a_1$,$17a_2$ as shown in FIG. 3D, the ribs are raised further gradually.

Figure 3E:
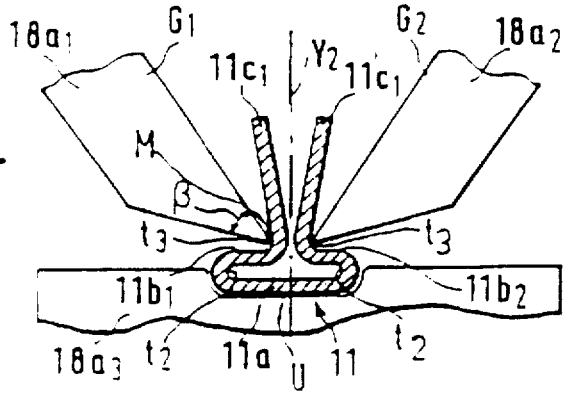

The last forming stage is carried out by means of the former wheels 18 shown in FIG. 3E. As is shown in FIG. 3E as well as FIG. 4, the two upper wheels $18a_1$,$18a_2$ are mounted to revolve on the shafts $a_{11}$ and $a_{12}$ on branches $R_{10}'$ and $R_{10}''$ of the frame section $R_{10}$. Sides $G_1$ and $G_2$ of the upper wheels $18a_1$ and $18a_2$ are placed one facing the other and at an acute angle $\alpha_1$ in relation to one another. The tip angles β of the wheel tips M are acute. The lower wheel $18a_3$ revolves on the shaft $a_{10}$ and comprises a groove U into which the base portion 11*a* of the band is placed. In operation, the tips M of the upper pair of wheels $18a_1$ and $18a_2$ are placed against the fold $t_3$ and raise the needle ribs into the ultimate angle while, at the same time, pressing the top portions $11b_1$,$11b_2$ placed above the base part 11*a* into the ultimate position parallel to the base part 11*a*.

Figure 4:
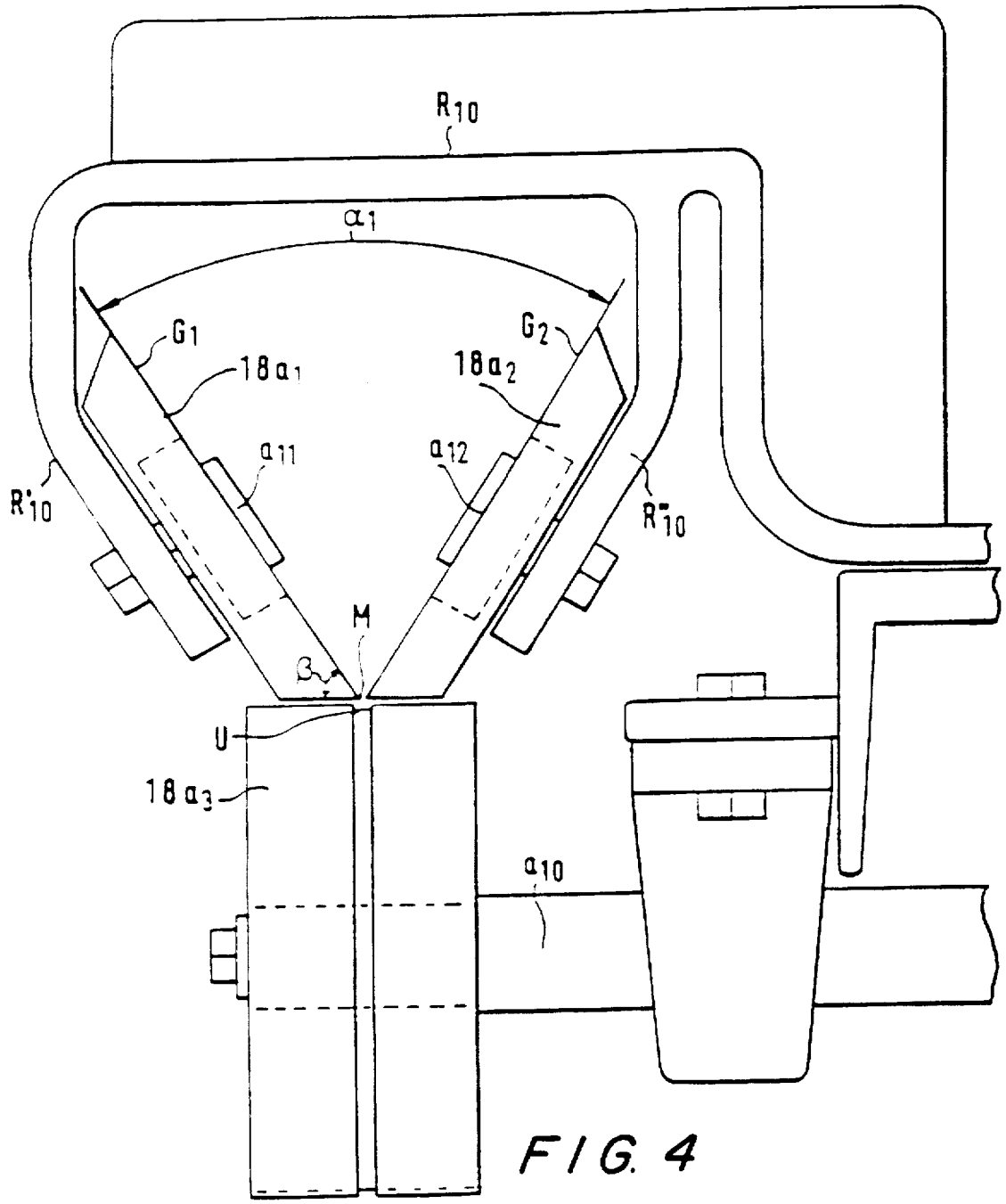
FIG. 4 is a view of the former wheels which perform the step of FIG. 3E.

FIG. 4 is a separate illustration of the former wheels of the forming stage of FIG. 3E showing the apparatus in greater detail. The wheels $18a_1$ and $18a_2$ are mounted on the shafts $a_{11}$ and $a_{12}$ which are connected to the branches $R_{10}'$ and $R_{10}''$ of the frame $R_{10}$. The roller wheel $18a_3$ is rotated by means of the shaft $a_{10}$. The rotating drive is applied to the shaft $a_{10}$ from the belt H. The roll $18a_3$ comprises the groove U passing around the roll in its middle area and the wheels $18a_1$ and $18a_2$ comprise faces $G_1$ and $G_2$, which are placed at an angle $\alpha_1$ in relation to one another, which angle is in the range of from about 55° to about 65°. The tip angles β of the wheels $18a_1$ and $18a_2$ are in the range of from about 50° to about 60°.

The examples provided above are not meant to be exclusive. Many other variations of the present invention would be obvious to those skilled in the art, and are contemplated to be within the scope of the appended claims.

I claim:

1. An apparatus for manufacturing a needle-rib heat-exchanger construction which comprises an elongate tube and a band wound onto said tube, the band having a central portion and a lateral portion on each side of said central portion, comprising cutting means for cutting the lateral portions of the band, a set of former wheels structured and arranged for shaping the cut band to include a bottom part having first and second longitudinally extending edge regions, top portions formed from the lateral portions of the band between adjacent cuts in the band, said top portions formed from the lateral portions of the band between each pair of adjacent cuts being arranged in opposed relationship to a respective one of said first and second edge regions of said bottom part, and needle-shaped ribs formed from the lateral portions of the band between the adjacent cuts in the band, said needle-shaped ribs formed from the lateral portion of the band between each pair of adjacent cuts projecting from a respective one of said top portions and being situated at an angle in relation to one another, first rotation means for rotating said former wheels, and second rotation means for rotating the tube and moving the tube in the longitudinal direction, the band being guided against said rotating former wheels and wound onto the tube.

2. The apparatus of claim 1, wherein said set of former wheels comprises nip-defining first and second former wheels, said first former wheel comprising a projection and a recess on both sides of said projection, said second former wheel comprising a recess and a projection on both sides of said recess and having a complementary shape to said first wheel, the band being passed through said first and second former wheel such that folds are formed into the band by the cooperating projections and recesses to enable bending of said top portions to face the respective one of said first and second edge regions of said bottom part.

3. The apparatus of claim 1, wherein said set of former wheels comprises nip-defining first and second former wheels, said first former wheel comprising a groove and opposed conical faces adjoining said groove, defining a space therebetween in which the band is passed and arranged at an angle in relation to one another, said second former wheel comprising a cylindrical press wheel for pressing the band at a location between said opposed conical faces to form said needle-shaped ribs.

4. The apparatus of claim 1, wherein said set of former wheels comprises first, second and third former wheels, said first and second former wheels each defining a nip with said third former wheel, said first and second former wheels being rotatable and having a tip with an angle of from about 50° to about 60°, each of said tips engaging a fold in the band between one of said top portions and a respective one of said needle-shaped ribs, and said first and second former wheels having side faces placed at an angle in relation to one another.

5. The apparatus of claim 4, wherein said third former wheel comprises a groove receivable of said bottom part of the band, the angle between said side faces of said first and second former wheels being from about 55° to about 65°.

6. The apparatus of claim 4, wherein said third former wheel is rotated by said first rotation means.

7. The apparatus of claim 1, wherein said first rotation means comprise a motor having an output shaft and a belt coupling said output shaft to at least some of said former wheels.

8. The apparatus of claim 1, wherein said cutting means comprise a punching device including a fixed blade and a movable cutting blade, said movable cutting blade impacting said fixed blade to form the cuts in the lateral portions of the band.

9. The apparatus of claim 1, further comprising adhesion means for applying an adhesive agent to said bottom part of the band for causing adhesion of the band to the tube.

10. The apparatus of claim 9, wherein said adhesion means comprises a gluing device having a glue applicator wheel.

11. The apparatus of claim 1, wherein said second rotation means comprise three rotatable discs between which the tube is positioned.

12. The apparatus of claim 1, wherein said set of former wheels comprises nip-defining first and second former wheels, said first former wheel comprising a projection and a recess on both sides of said projection, said second former wheel comprising a recess and a projection on both sides of said recess and having a complementary shape to said first wheel, the band being passed through said first and second former wheel such that folds are formed into the band by the cooperating projections and recesses to enable bending of said top portions to face the respective one of said first and second edge regions of said bottom part, nip-defining third and fourth former wheels arranged after said first and second former wheels in the direction of travel of the band, said third former wheel comprising a groove and opposed conical faces adjoining said groove, defining a space therebetween in which the band is passed and arranged at an angle in relation to one another, said fourth former wheel comprising a cylindrical press wheel for pressing the band at a location between said opposed conical faces of said third former wheel to form said needle-shaped ribs, and fifth, sixth and seventh former wheels arranged after said third and fourth former wheels in the direction of travel of the band, said fifth and sixth former wheels each defining a nip with said seventh former wheel, said fifth and sixth former wheels being rotatable and having a tip with an angle of from about 50° to about 60°, each of said tips engaging a fold in the band between one of said top portions and a respective one of said needle-shaped ribs, and said fifth and sixth former wheels having side faces placed at an angle in relation to one another.

13. The apparatus of claim 1, wherein at least some of said former wheels in said set of former wheels are arranged in pairs.

14. The apparatus of claim 1, wherein said set of former wheels comprises a first substantially cylindrical former wheel having a wave form on an outer peripheral side surface thereof and a second substantially cylindrical former wheel having a form on an outer peripheral side surface thereof opposite to the wave form on said first former wheel, the band being passed between said first and second former wheels to be provided with folds based on the wave form of said first former wheel.

15. The apparatus of claim 1, wherein said set of former wheels shape the band such that said top portions are connected to the respective one of said first and second edge regions of said bottom part.

* * * * *